US007861568B2

(12) United States Patent
Nakamura et al.

(10) Patent No.: US 7,861,568 B2
(45) Date of Patent: Jan. 4, 2011

(54) PRESS FORMING DIE SET AND METHOD

(75) Inventors: Tsuyoshi Nakamura, Tochigi (JP); Yasuhiko Kitano, Tochigi (JP); Yoshimitsu Ishihara, Tochigi (JP); Shingo Maeda, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 206 days.

(21) Appl. No.: 12/025,204

(22) Filed: Feb. 4, 2008

(65) Prior Publication Data

US 2008/0184764 A1 Aug. 7, 2008

(30) Foreign Application Priority Data

Feb. 5, 2007 (JP) ..... 2007-025539
Feb. 7, 2007 (JP) ..... 2007-028362

(51) Int. Cl.
*B21D 22/00* (2006.01)

(52) U.S. Cl. ..... 72/350; 72/351

(58) Field of Classification Search ..... 72/347–351, 72/57

See application file for complete search history.

(56) References Cited

U.S. PATENT DOCUMENTS 4,195,510 A * 4/1980 Juergens ..... 72/350
5,901,599 A * 5/1999 Sato et al. ..... 72/350

FOREIGN PATENT DOCUMENTS

JP 09-029349 2/1997

* cited by examiner

*Primary Examiner*—Teresa M Bonk
(74) *Attorney, Agent, or Firm*—Rankin, Hill & Clark LLP

(57) ABSTRACT

A die set for press-forming a blank of thin metallic sheet. The die set has a punch and a blank holder. The blank holder has a first bead for restraining an edge of the blank with a constant force. The first bead is disposed further to an inside than a second bead for restraining the edge of the blank with a force that varies during pressing of the blank.

3 Claims, 9 Drawing Sheets

( COMP. EX. )

PRESS FORMING DIE SET AND METHOD

CROSS REFERENCE TO RELATED APPLICATIONS

This application claims priorities of Japanese patent applications 2007-025539 filed Feb. 5, 2007 and 2007-028362 filed Feb. 7, 2007.

FIELD OF THE INVENTION

The present invention relates to a press forming technique for draw-forming a thin metal sheet.

BACKGROUND OF THE INVENTION

A press-formed article can be obtained by placing a blank in a die provided with a concave part and drawing the convex part of a punch into the concave part. At this time, when the edges of the blank are held down by a blank holder, a neat formed article can be obtained that is free of wrinkles. However, rather than simply holding down the edges of the blank, it is preferable to adjust the restraining force in accordance with the progress of the press, i.e., the degree of progress of the draw process.

A press apparatus capable of adjusting the restraining force has been proposed in the past, e.g., in Japanese Patent Application Laying-Open Publication No. 9-29349 (JP 09-29349 A). The proposed press apparatus is described using FIG. 9 hereof.

As shown in FIG. 9, in the press apparatus described in JP 09-29349, the occurrence of fractures 120 in the raw material 111 is prevented by effecting variable point beads 105 in a point shape at the appropriate sites during an arbitrary portion of the forming period.

Fixing beads 103 are also provided to the outside of the variable point beads 105. When the fixing beads 103 are provided to the outside, the amount of cut material increases, and the yield is poor when the edges of the formed article are cut off after forming.

The blank is also drawn in towards the center in conjunction with pressing while being subjected to the restraining action of the fixing beads 103. Since the fixing beads are on the outside, a large distance occurs between the fixing beads 103 and the forming part. The larger this distance, the more likely it is that wrinkling will occur along the distance, and the wrinkle-preventing effects of the fixing beads 103 are diminished.

Furthermore, since the variable point beads 105 are provided more towards the inside than the fixing beads 103, the movement mechanism for moving the variable point beads 105 is disposed to the inside of the fixing beads 103. However, the space to the inside of the fixing beads 103 is limited, and the movement mechanism is therefore subject to space limitation, and unavoidably has a complex structure. A complex movement mechanism is not preferred, because the cost of the press apparatus increases.

Specifically, the press apparatus of JP 09-29349 A has drawbacks with respect to yield rate, wrinkling, and structure, and there is a need for a press forming die that has a good yield rate, no occurrence of wrinkling, and a simple structure.

SUMMARY OF THE INVENTION

According to an aspect of the present invention, there is provided a die set for press-forming a blank, which comprises: a die having a concave part; a punch disposed in confronting relation to the die and having a convex part for penetrating into the concave part; and a blank holder disposed to surround the punch and having a first bead for restraining an edge of the blank with a constant force during pressing of the blank and a second bead, disposed further to an outside than the first bead, for restraining the blank edge with a force that varies during pressing of the blank.

In this arrangement, the first bead as a fixing bead is disposed on the inside, and the second bead as a movable bead is disposed on the outside. Since the fixing bead is disposed on the inside, the amount of cut material is reduced, and the yield rate is satisfactory when the edges are cut after forming.

Since the fixing bead is disposed on the inside, the fixing bead and the forming part are also adjacent. As a result, wrinkling is unlikely to occur, and a formed article having a satisfactory shape can be obtained.

According to a second aspect of the present invention, there is provided a method for press-forming a blank using a press-forming die set that comprises: a die having a concave part; a punch disposed in confronting relation to the die and having a convex part for penetrating into the concave part; and a blank holder disposed to surround the punch and having a first bead for restraining an edge of the blank with a constant force during pressing of the blank and a second bead, disposed further to an outside than the first bead, for restraining the blank edge with a force that varies during pressing of the blank. The method comprising the steps of: forming while restraining the blank using the second bead that is controlled to an intermediate restraining force which is sufficient to prevent wrinkling from occurring during forming of the blank; forming while restraining the blank using the second bead that is controlled to a small restraining force which is smaller than the intermediate restraining force and that does not impede a flow of the blank into the concave part; and forming while restraining the blank using the second bead that is controlled to a large restraining force which is larger than the intermediate restraining force and which inhibits the blank from flowing into the concave part.

In this method, since forming at the initial stage of forming is performed while the blank is restrained by an intermediate restraining force, wrinkles can be prevented from occurring. Since forming at the intermediate stage of forming is performed while the blank is restrained by a small restraining force, cracks can be prevented from occurring. Since forming at the final stage of forming is performed while the blank is restrained by a large restraining force, the shape of the formed article can be satisfactorily regulated.

According to a third aspect of the present invention, there is provided a die set for press-forming a blank, comprising: a die having a concave part; a punch disposed in confronting relation to the die and having a convex part for penetrating into the concave part; a first blank holder disposed to surround the die and having a first bead for restraining an edge of the blank with a constant force during pressing of the blank and a first holder surface, disposed adjacent to the first bead, for supporting the blank edge; a second blank holder disposed further to an outside than the first holder surface and having a second bead for restraining the blank edge with a force that varies during pressing of the blank and a second holder surface, disposed adjacent to the second bead, for supporting the blank edge; and a pad, disposed on the die, for elastically pushing on the second holder surface via the blank.

In the this arrangement, since the second bead moves together with the second holder surface, the restraining force of the second blank holder is shared between the second bead and the second holder surface. As a result, there is no risk of the restraining force being concentrated at the second bead, and the amount of friction on the second bead can be significantly reduced.

Since the second bead is formed by a portion of the second blank holder, there is no risk of the second bead solely changing position with respect to other members. As a result, the restraining force provided by the second bead is stabilized.

Furthermore, the blank holder is divided into a first blank holder and a second blank holder, and there is therefore no need for the second bead to be housed in the blank holder. As a result, the press forming die can be endowed with a simple structure.

Preferably, the second bead is provided in a position nearer the convex part than the second holder surface, at an edge of the second blank holder. Since the second bead is disposed adjacent to the convex part, the blank can be reduced in size, and material cost can be reduced.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
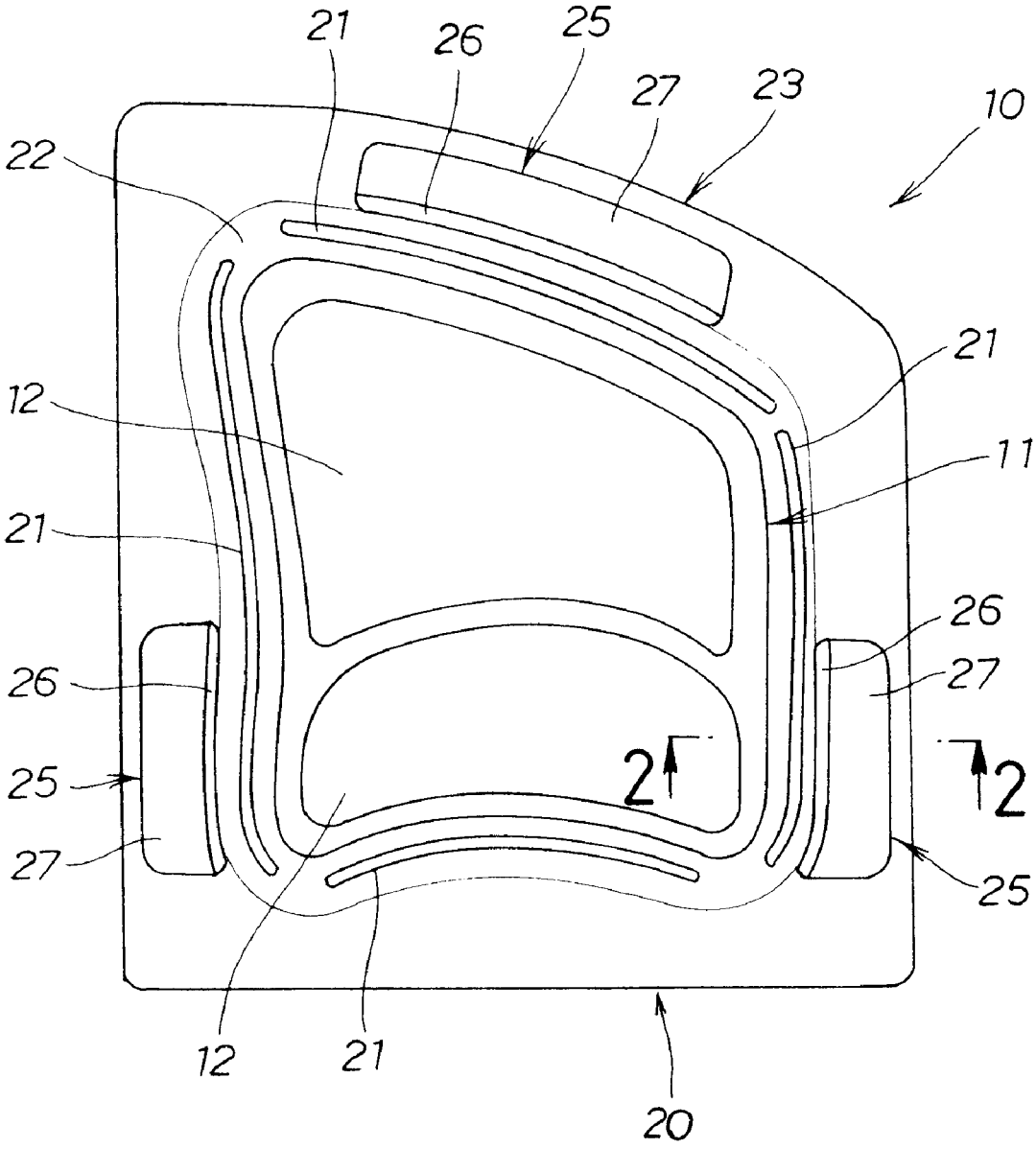
FIG. 1 is a top plan view illustrating a punch and a blank holder of a press-forming die according to the present invention.

As shown in FIG. 1, a punch 11 of a press forming die set 10 is provided with convex parts 12, 12. A blank holder 20 is also provided so as to surround the punch 11.

The blank holder 20 is composed of a first blank holder 23 having first beads 21, 21, 21, 21 that function as fixing beads, and a first holder surface 22 that is a mouth-shaped flat surface; and second blank holders 25, 25, 25 that are housed within the first blank holder 23 so as to be able to move in the front and back directions in the drawing.

The second blank holders 25 have a second bead 26 that functions as a movable bead, and a second holder surface 27 that is an I-shaped flat surface. The second bead 26 is disposed closer to the convex part 12 than the second holder surface 27, i.e., further inward.

Specifically, the second bead 26 is provided to the edge of the second blank holder 25 so as to be closer to the convex part 12 than the second holder surface 27.

Since the blank holder 20 is divided into the first blank holder 23 and the second blank holders 25, there is no need for the second bead 26 to be enclosed by the first blank holder 23. The structure of the press forming die set 10 can be simplified in comparison to a case in which the second bead 26 is provided separately from the first blank holder 23.

The relevant parts of the press forming die set 10 will next be described based on FIG. 2, which is a sectional view along line 2-2 in FIG. 1.

Figure 2:
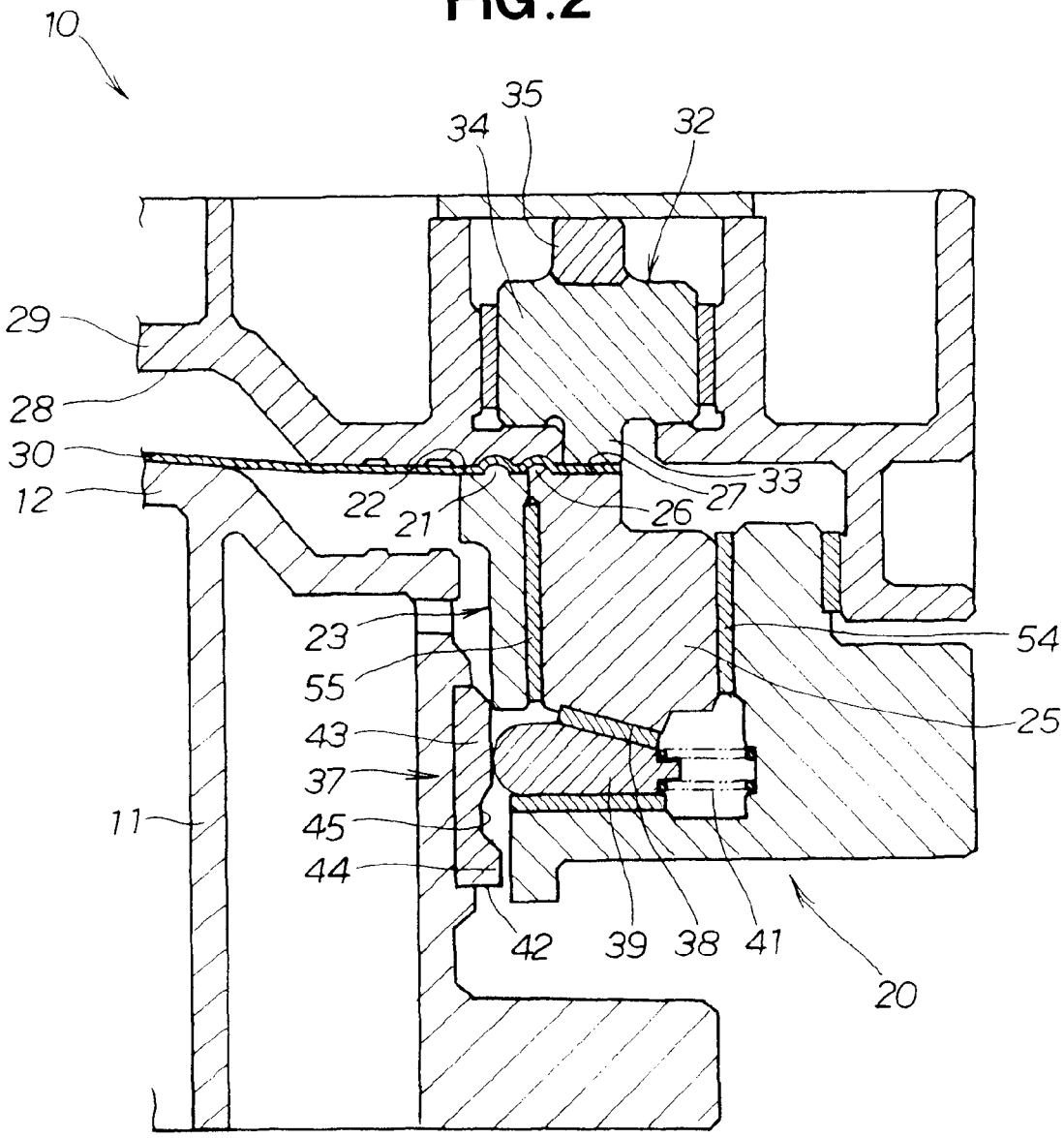
FIG. 2 is cross-sectional view taken along line 2-2 of FIG. 1.

As shown in FIG. 2, the press forming die set 10 is provided with a die 29 to which a concave part 28 is provided; a punch 11 disposed so as to face the die 29, to which a convex part 12 is provided for penetrating into the concave part 28; and a first blank holder 23 provided with a first bead 21 for restraining the edge of the blank 30 with a constant force during pressing, disposed so as to surround the punch 11, and a first holder surface 22 for supporting the edge of the blank 30, disposed adjacent to the first bead 21. The press forming die set 10 further comprising a second blank holder 25 provided with a second bead 26 for restraining the edge of the blank 30 with a force that varies during pressing, disposed further to the outside (to the right in the drawing) than the first holder surface 22, and a second holder surface 27 for supporting the edge of the blank 30, disposed adjacent to the second bead 26; and a pad 32 provided to the die 29, for elastically pushing on the second holder surface 27 via the blank 30.

The pad 32 is composed of a pad main body 34 having a protruding part 33 at the bottom thereof, and an elastic body 35 that is attached on top of the pad main body 34. The lower surface of the protruding part 33 comes in contact with the blank 30. Blocks of hard cast iron or cast steel are suitable for use as the protruding part 33 and the pad main body 34.

The elastic body 35 is preferably composed of urethane rubber or a spring. When a large upward external force is applied to the protruding part 33, the elastic body 35 contracts, and the pad main body 34 moves upward. When the upward external force is small, the elastic body 35 expands, and the pad main body 34 moves downward. Consequently, the protruding part 33 moves upward and downward according to the upward external force.

The second blank holder 25 is driven by a cam driver mechanism 37 described hereinafter. The cam driver mechanism 37 is composed of a tilted surface 38 provided to the bottom of the second blank holder 25; a tapered member 39 that is adjacent to the tilted surface 38 and can move to the left and right in the drawing; a compression spring 41 that extends from the first blank holder 23 towards the tapered member 39 in order to urge the tapered member 39 to the left in the drawing; and a driver cam 42 that is attached to the side surface of the punch 11 so as to drive the tapered member 39 to the right in the drawing. The driver cam 42 has a first ridge 43 that protrudes to the right in the drawing, a second ridge 44 that is higher than the first ridge 43, and a trough 45 that is provided between the ridges 43, 44.

The operation of the press forming die configured as described above will next be described. The process in which the punch 11 moves in relative fashion from the upper dead point to the lower dead point will be described in three stages that include the initial stage of forming, the intermediate stage of forming, and the final stage of forming. The three stages are composed of a first step, a second step, and a third step.

The first step corresponding to the initial stage of formation will be described based on FIGS. 3A and 3B.

Figure 3A:
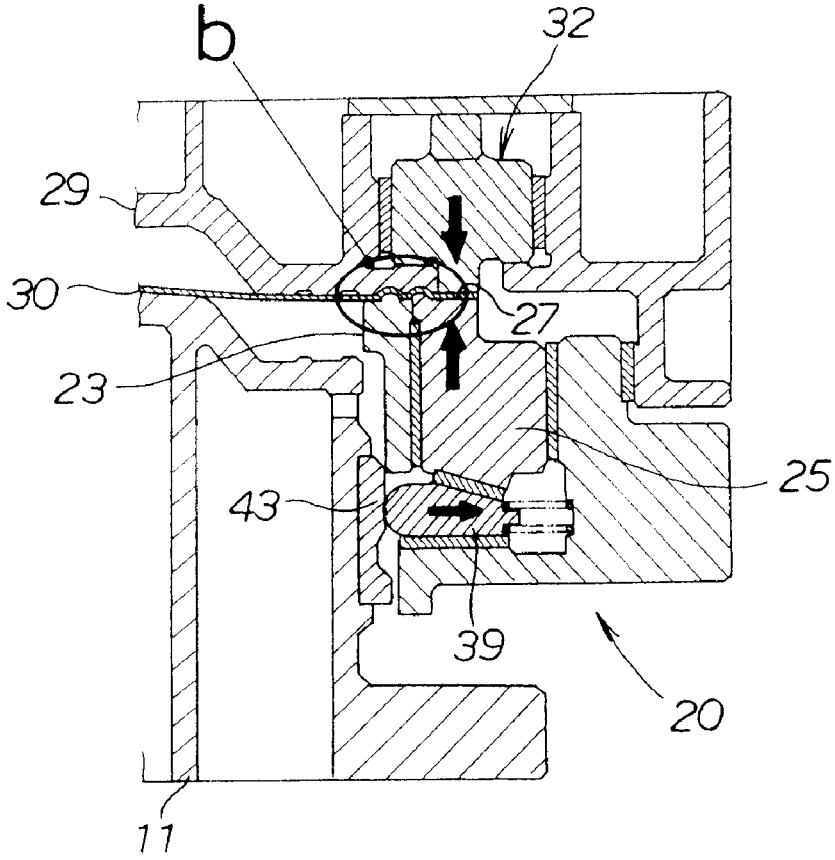
FIGS. 3A and 3B are cross-sectional views illustrating a first stage of a blank press-forming method according to the present invention.

As shown in FIG. 3A, for convenience, the punch 11 is fixed, and the die 29 and the blank holder 20 are moved downward. When the press slide stroke from the upper dead point to the lower dead point is 100%, the press slide stroke during the initial stage of formation is 0 to 60% (the slide height from the lower dead point is 100 to 40%).

In the initial stage of formation, the blank 30 is pushed into the die 29 by the first blank holder 23. Furthermore, the tapered member 39 is moved to the right in the drawing, and the second blank holder 25 is raised by the first ridge 43. The blank 30 is then held between the second holder surface 27 and the pad 32.

Figure 3B:
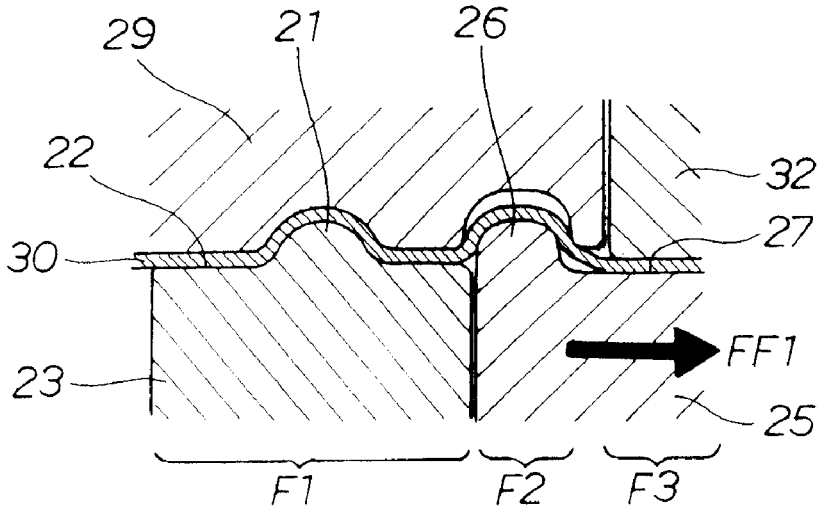

As shown in FIG. 3B, which is an enlarged view of the area indicated by the letter b in FIG. 3A, the blank 30 is restrained by a constant restraining force F1 while being bent by the first bead 21 and the first holder surface 22.

The second bead 26 moderately penetrates into the blank 30. Assuming that the bead height is zero in the position (position in which the second bead 26 comes into contact with the lower surface of the blank 30) at which the second bead 26 starts to bend the blank 30 upward, and that the bead height is 100% in the position in which the second bead 26 reaches the upper limit, the bead height in the moderate penetration is set to 80 to 100%.

The blank 30 is thereby restrained by a force F2 while being bent by the second bead 26.

Furthermore, since the blank 30 is held between the second holder surface 27 and the pad 32, the blank 30 is restrained by a force F3.

As a result, the blank 30 the restrained by a restraining force FF1 that is proportional to F1+F2+F3. This restraining force FF1 corresponds to a restraining force sufficient to prevent wrinkling of the blank 30.

The second step corresponding to the intermediate stage of forming will next be described based on FIGS. 4A and 4B.

Figure 4A:
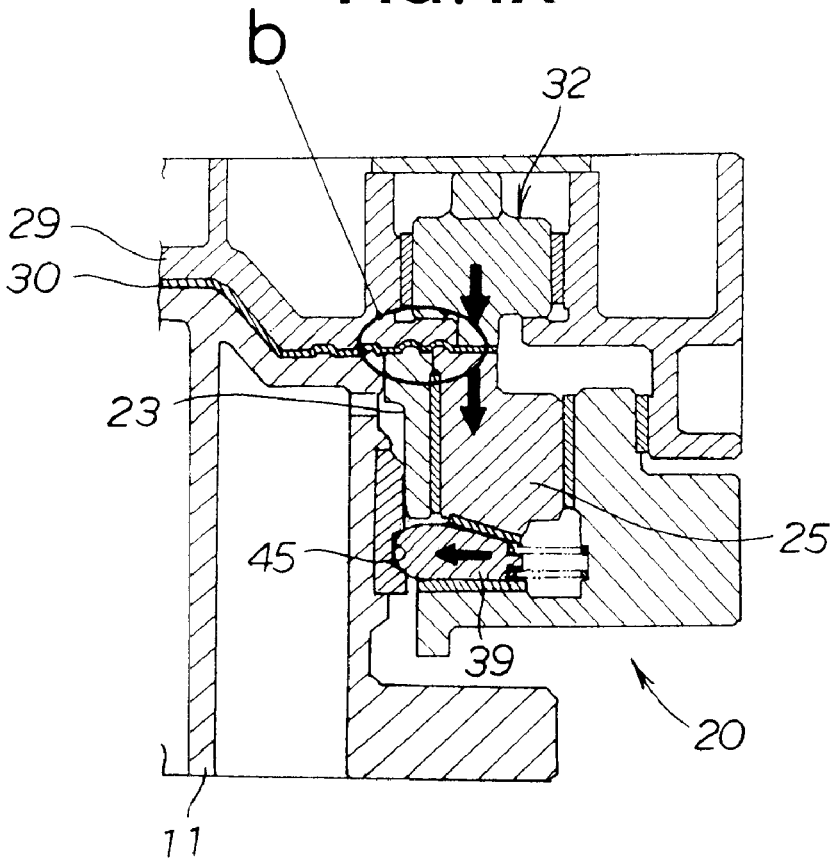
FIGS. 4A and 4B are cross-sectional views illustrating a second stage of the blank press-forming method.

As shown in FIG. 4A, during the intermediate stage of forming, the blank 30 is pushed into the die 29 by the first blank holder 23. Furthermore, the tapered member 39 is moved to the left in the drawing by the trough 45, and the second blank holder 25 moves downward. The press slide stroke in the intermediate stage of forming is 30% to 100% (the slide height from the lower dead point is 70% to 0).

Figure 4B:
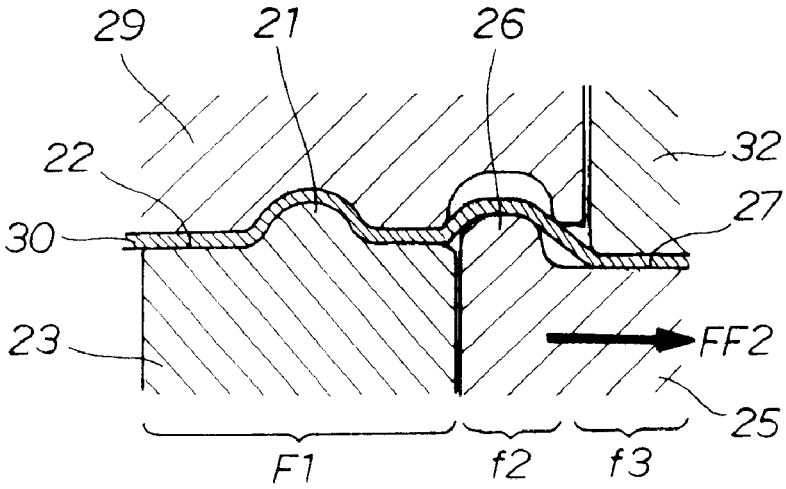

As shown in FIG. 4B, which is an enlarged view of the area indicated by the letter b in FIG. 4A, the blank 30 is restrained by a constant restraining force F1 while being bent by the first bead 21 and the first holder surface 22.

The second bead 26 slightly penetrates into the blank 30. The bead height is set to 10% to 80% in the slight penetration. The blank 30 is thereby restrained by a weak force f2 while being bent on a small scale by the second bead 26.

Furthermore, since the blank 30 is clamped by the second holder surface 27 and the pad 32, the blank 30 is restrained by a weak force f3.

As a result, the blank 30 is restrained by a restraining force FF2 that is proportional to F1+f2+f3, but the restraining force FF2 is smaller than the restraining force FF1. Therefore, the blank 30 is not prevented from moving to the left in the drawing. Specifically, inflow of the blank 30 occurs.

The third step corresponding to the final stage of forming will next be described based on FIGS. 5A and 5B.

Figure 5A:
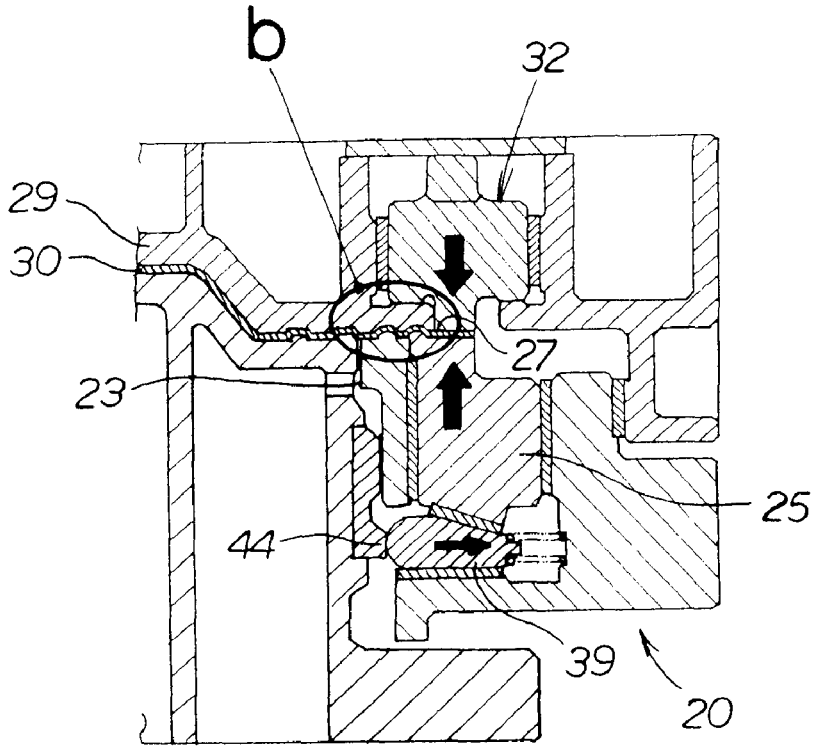
FIGS. 5A and 5B are cross-sectional views illustrating a third stage of the blank press-forming method.

As shown in FIG. 5A, the final stage of forming, the blank 30 is pushed into the die 29 by the first blank holder 23. Furthermore, the tapered member 39 is moved significantly to the right in the drawing by the second ridge 44, and the second blank holder 25 moves upward significantly. The blank 30 is then securely held between the second holder surface 27 and the pad 32. The press slide stroke in the final stage of forming is 80% to 100% (the slide height from the lower dead point is 20% to 0).

Figure 5B:
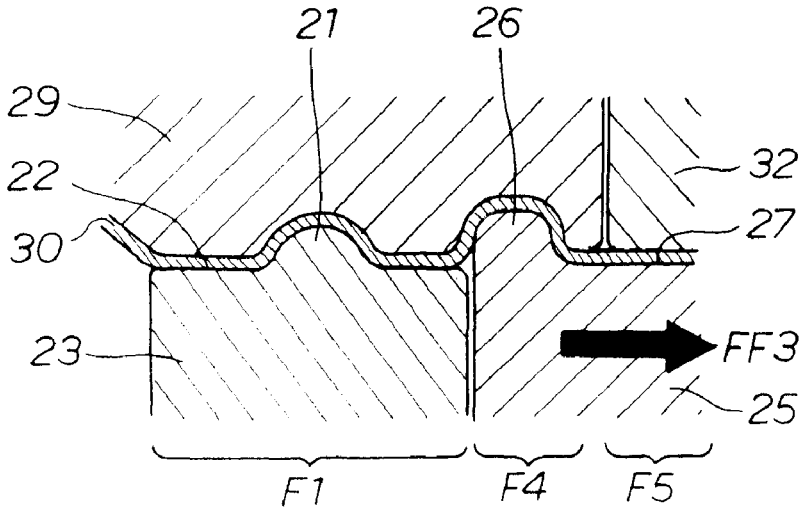

As shown in FIG. 5B, which is an enlarged view of the area indicated by the letter b in FIG. 5A, the blank 30 is restrained by a constant restraining force F1 while being bent by the first bead 21 and the first holder surface 22.

The second bead 26 strongly penetrates into the blank 30. The bead height is set to 90% to 100% in the strong penetration. The blank 30 is thereby restrained by a force F4 while being strongly bent by the second bead 26.

Furthermore, since the blank 30 is clamped by the second holder surface 27 and the pad 32, the blank 30 is restrained by a force F5.

As a result, the blank 30 is restrained by a restraining force FF3 that is proportional to F1+F4+F5, but since F4 is larger than F2, and F5 is larger than F3, the restraining force FF3 is larger than the restraining force FF1, and the edge of the blank 30 is strongly restrained.

The relationship between the blank yield rate and the bead position will be described.

As shown in FIG. 5B, the second bead 26 must continue to press the blank 30 even in the final stage of forming. Therefore, the size of the blank 30 prepared prior to forming is determined based on the position of the second bead 26. Specifically, the blank 30 enlarges the further the second bead 26 moves to the right in the drawing. In this regard, when the second bead 26 can be provided to the left edge of the second blank holder 25, the size of the blank 30 can be at a minimum, and a satisfactory yield rate can be obtained.

The relationship between the restraining forces FF1 through FF3 and the press stroke described above can be summarized as shown in FIG. 6.

Figure 6:
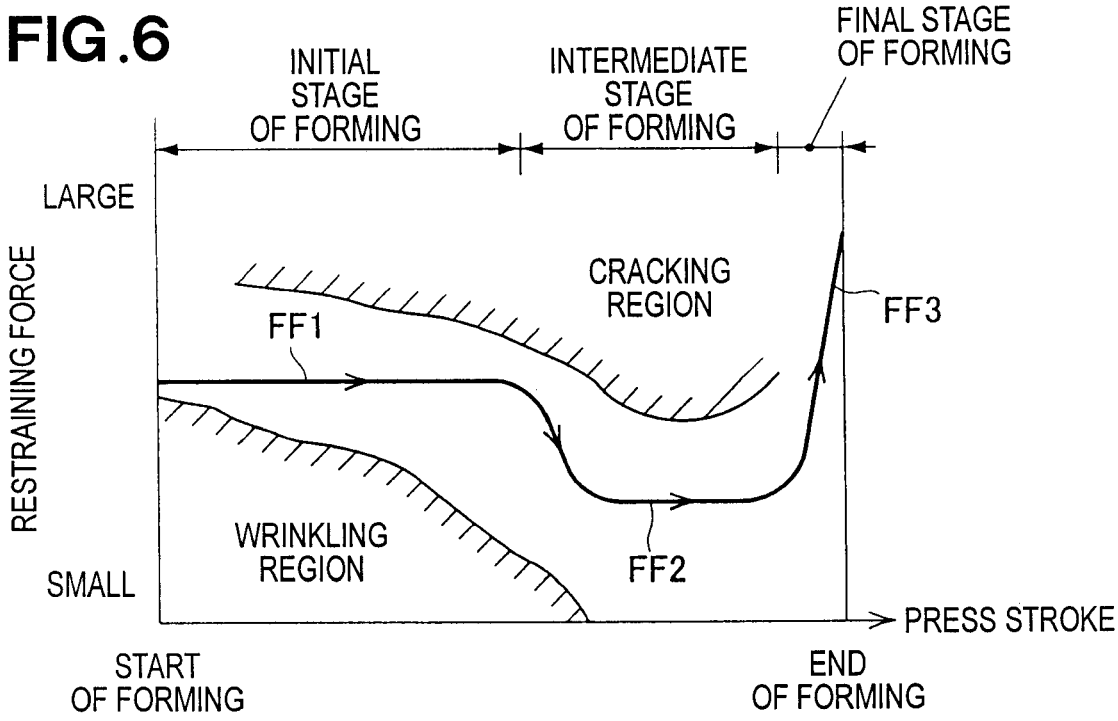
FIG. 6 is a graph showing a relationship between a restraining force and a press stroke.

As shown in FIG. 6, the process from start to finish of forming indicated by the horizontal axis is divided into the initial stage of forming, the intermediate stage of forming, and the final stage of forming. The period of the initial stage of forming, the intermediate stage of forming, and the final stage of forming (the length along the horizontal axis) is determined by the shape of the driver cam 42 (FIG. 2).

When the restraining force is inadequate in the initial stage of forming, the blank flows in excessively, and wrinkling occurs. This region is indicated in the graph as the "wrinkling region." Since draw processing progresses actively in the intermediate stage of forming, inflow of the blank is inadequate when the restraining force is large, and cracking occurs. This region is indicated in the graph as the "cracking region."

In the present invention, the restraining force of the initial stage of forming is set to the intermediate level of FF1, the restraining force in the intermediate stage of forming is set to the small force of FF2, and the restraining force in the final stage of forming is set to the large force of FF3, whereby the wrinkling region and the cracking region are not entered. Since the extension in the blank is slight in the final stage of forming, there is no risk of cracking even when the restraining force is large.

Setting of the restraining force was described on the basis of the sectional views in FIGS. 3 through 5 described above. The operation will be described based on plan views using FIGS. 7A through 7C.

Figure 7A:
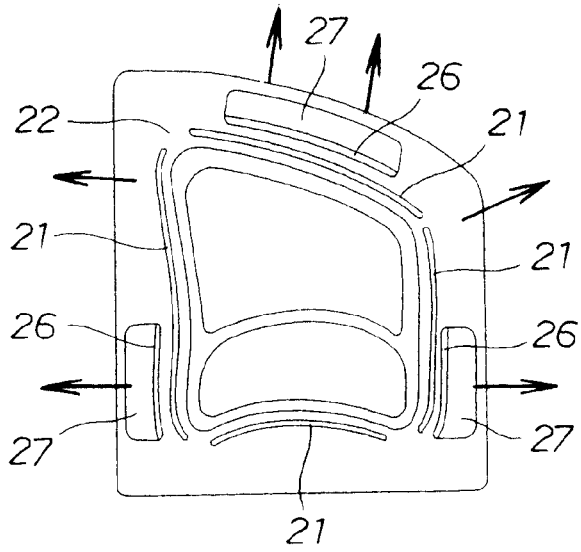
FIGS. 7A through 7C are schematic views illustrating an operation of the arrangement of FIG. 1.

In the initial stage of forming (first step), the intermediate-level restraining action of the second beads 26, 26, 26 and the second holder surfaces 27, 27, 27 is added to the restraining action of the first beads 21, 21, 21, 21 and the first holder surface 22, and the edges of the blank can therefore be restrained by an intermediate-level restraining force as indicated by the six arrows as shown in FIG. 7A. Draw processing in the initial stage of forming can be performed while restraining the blank so that wrinkling does not occur.

Figure 7B:
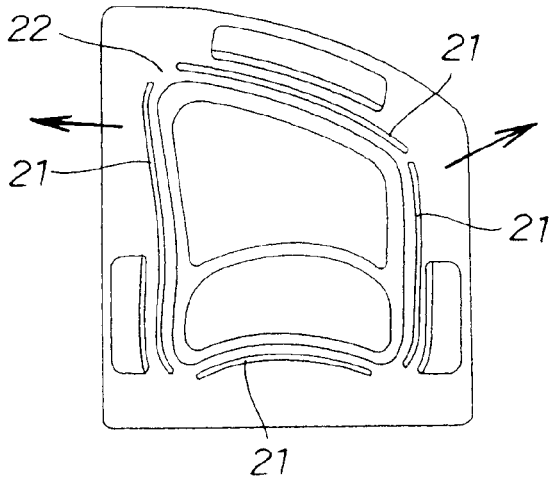

In the intermediate stage of forming (second step), the restraining action of the first beads 21, 21, 21, 21 and the first holder surface 22 is the primary force, and the edges of the blank are therefore restrained by a small force as indicated by the two arrows in FIG. 7B. Specifically, in draw processing of the intermediate stage of forming, inflow of the material is accelerated to prevent cracking, and the blank is held by the second holder surfaces 27, 27, 27, whereby the occurrence of wrinkling is suppressed. Since wrinkling would occur if the peripheral edge of the blank were not restrained, the action of the second holder surfaces 27, 27, 27 is important.

Figure 7C:
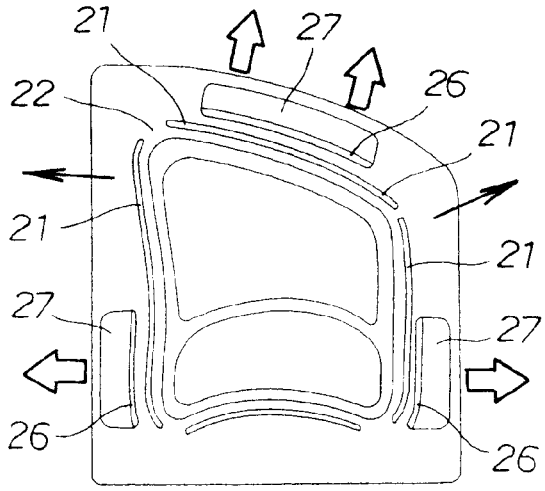

In the final stage of forming (third step), the large restraining action of the second beads 26, 26, 26 and the second holder surfaces 27, 27, 27 indicated by the four outlined arrows is added to the restraining action of the first beads 21, 21, 21, 21 and the first holder surface 22 indicated by the two arrows, and the edges of the blank can therefore be restrained by a large restraining force, as shown in FIG. 7C. The final shape of the formed article can thereby be adjusted, and a formed article having a satisfactory shape can be obtained.

Figure 8A:
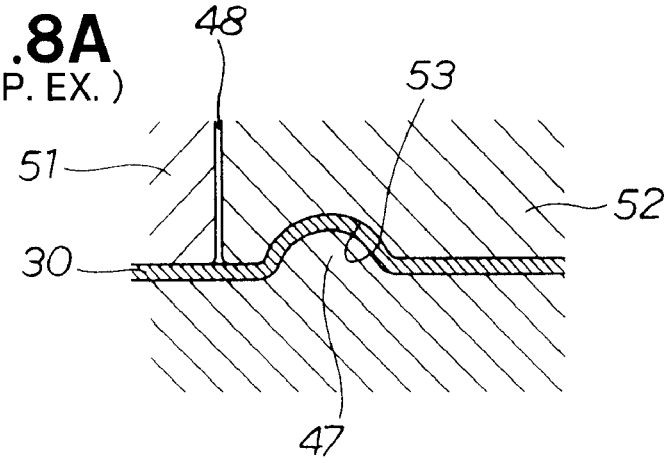
FIG. 8A is a schematic partial view showing a comparative known example wherein a die is divided.
Figure 8B:
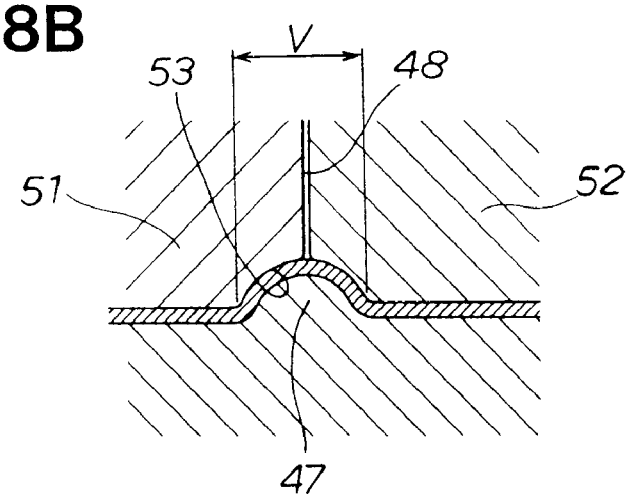
FIGS. 8B and 8C are schematic views showing an embodiment according to the present invention, wherein the die is divided.
Figure 8C:
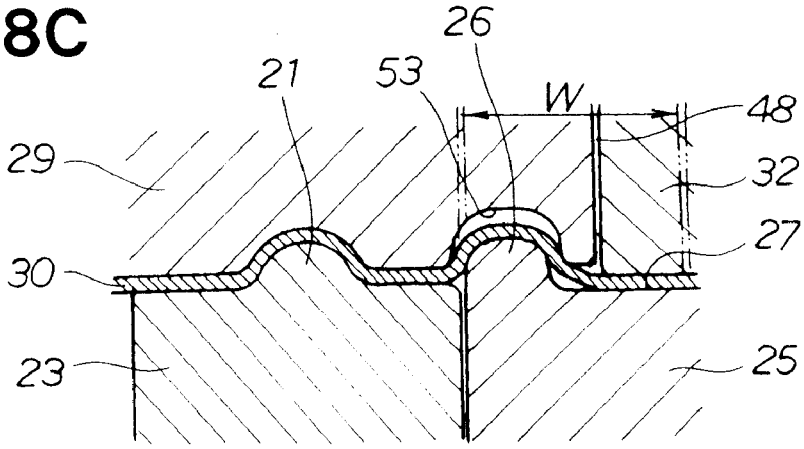
Figure 9:
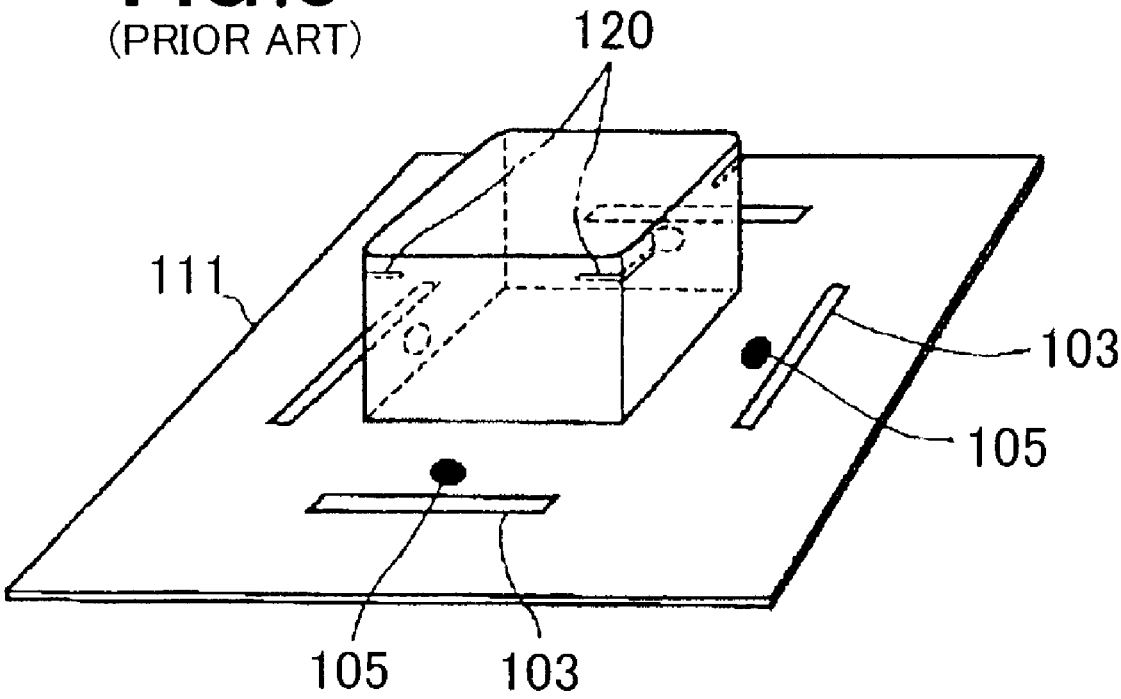
FIG.9 (PRIOR ART)
FIG. 9 is a schematic perspective view showing a conventional press apparatus.

Since a movable bead is employed, and for other reasons, the division position will be investigated based on FIGS. 8A through 8C in preparation for a case in which the die must be divided.

As shown in FIG. 8A, which shows a comparative example, a division 48 is set in a position to the left (or right) of the bead 47, and the die is divided into a first die 51 and a second die 52. The lower surfaces of the first die 51 and the second die 52 must be aligned. However, a difference in level unavoidably occurs between the lower surface of the first die 51 and the lower surface of the second die 52. This level difference causes flaws and burning to occur in the blank 30. The configuration shown in FIG. 8A therefore cannot be employed.

As shown in FIG. 8B showing the embodiment, the division 48 is provided to a concave part 53 that corresponds to the bead 47. Since the concave part 53 has a curved surface, the degree of contact with the blank 30 is moderate. Therefore, no problem occurs even when there is a level difference between the first die 51 and the second die 52. The division 48 may be provided in any position within the interval V.

As shown in the reproduction of FIG. 4B in FIG. 8C showing the embodiment, when the pad 32 is present, the pad 32 can move vertically, and there is no adverse effect on the blank 30. Therefore, the divisions 48 between the pad 32 and the die 29 can be set to the concave part 53 that corresponds to the second bead 26, and the portion that corresponds to the second holder surface 27, as indicated by the interval W.

Specifically, it is recommended that the division 48 of the die or other die be provided to the concave part 53 or the convex part of the bead 47, and this range may be expanded when the pad 32 is present.

The positional relationship between the first bead 21 and the second bead 26 will next be described based on FIGS. 1 and 2.

As shown in FIG. 1, the first beads 21, 21, 21, 21 substantially surround the punch 11. On the other hand, the second beads 26, 26, 26 partially surround the punch 11. The first beads 21, 21, 21, 21 restrain the blank with a constant force from the initial stage of forming to the final stage of forming, and contribute to determining the shape of the formed article.

The important first beads 21, 21, 21, 21 thus affect the shape control the closer the first beads 21, 21, 21, 21 are to the punch 11. Accordingly, the first beads 21, 21, 21, 21, which are more stable than the second beads 26, 26, 26, which have large fluctuation factors, are placed close to the punch 11 in the present invention.

Specifically, the first beads 21, 21, 21, 21 are disposed towards the inside, and the second beads 26, 26, 26 are disposed towards the outside.

As a result, the second blank holders 25, 25, 25 can be provided to the first blank holder 23 having the first beads 21, 21, 21, 21. Specifically, as shown in FIG. 2, a configuration is adopted in which liners 54, 55 are affixed to the first blank holder 23, and the second blank holder 25 is guided by the liners 54, 55 so as to be able to move upward and downward.

Besides the cam driver mechanism described in the embodiment, the means for raising and lowering the second blank holder 25 that includes the second beads 26 may be a hydraulic cylinder in which the pressing force can be controlled, or a mechanical cylinder driven by a servo motor.

Obviously, various minor changes and modifications of the present invention are possible in light of the above teaching. It is therefore to be understood that within the scope of the appended claims the invention may be practiced otherwise than as specifically described.

What is claimed is:

1. A method for press-forming a blank using a press-forming die set comprising: a die having a concave part; a punch disposed in confronting relation to the die and having a convex part for penetrating into the concave part; and a blank holder disposed to surround the punch and having a first bead that restrains an edge of the blank with a constant restraining force during pressing of the blank and a second bead, disposed further to an outside than the first bead such that said first bead is disposed relatively between said second bead and said punch, that restrains the blank edge with a force that varies during pressing of the blank, the method comprising the steps of:

forming while restraining the blank with the first bead, which is applying said constant restraining force, and with the second bead, which is applying an intermediate restraining force, said constant restraining force and said intermediate restraining force being sufficient to prevent wrinkling from occurring during forming of the blank;

forming while restraining the blank with the first bead, which is applying said constant restraining force, and with the second bead, which is applying a small restraining force, said small restraining force being less than the intermediate restraining force, and whereon said constant restraining force together with said small restraining force do not impede a flow of the blank into the concave part; and forming while restraining the blank with the first bead, which is applying said constant restraining force, and with the second bead, which is applying a large restraining force, said large restraining force being larger than the intermediate restraining force, and wherein said constant restraining force together with said large restraining force are sufficient to inhibit the blank from flowing into the concave part.

2. A die set for press-forming a blank, comprising:

a die having a concave part;

a punch disposed in confronting relation to the die and having a convex part for penetrating into the concave part;

a first blank holder disposed to surround the die and having a first bead that restrains an edge of the blank with a constant force during pressing of the blank and a first holder surface, disposed adjacent to the first bead, that supports the blank edge;

a second blank holder disposed further to an outside than the first holder surface such that said first blank holder is disposed relatively between said punch and said second blank holder, said second blank holder having a second bead that restrains the blank edge with a force that varies during pressing of the blank and a second holder surface, disposed adjacent to the second bead, that supports the blank edge; and a pad, disposed on the die, that elastically pushes on the second holder surface via the blank.

3. The die set of claim 2, wherein the second bead is provided in a position nearer the convex part than the second holder surface, at an edge of the second blank holder, and such that the second bead is disposed relatively between the second holder surface and the convex part.

* * * * *